United States Patent [19]

Lotz

[11] Patent Number: 4,566,676

[45] Date of Patent: Jan. 28, 1986

[54] SHORT TIP FOR A TORCH AND A TORCH TYPE TOOL

[76] Inventor: Horst K. Lotz, Kiefernweg 13, DE-6200 Wiesbaden-Delkenheim, Fed. Rep. of Germany

[21] Appl. No.: 507,982

[22] Filed: Jun. 27, 1983

[30] Foreign Application Priority Data

Jun. 26, 1982 [DE] Fed. Rep. of Germany ... 8218358[U]
Sep. 17, 1982 [DE] Fed. Rep. of Germany ... 8226246[U]
Jan. 11, 1983 [DE] Fed. Rep. of Germany ... 8300552[U]

[51] Int. Cl.[4] ..... B23K 7/00
[52] U.S. Cl. ..... 266/48; 266/51; 266/53
[58] Field of Search ..... 266/48, 51, 53

[56] References Cited

U.S. PATENT DOCUMENTS 2,521,199 9/1950 Babcock ..... 148/9
2,531,174 11/1950 Tomlin ..... 266/48
4,287,005 9/1981 Engel ..... 266/53

*Primary Examiner*—Wayland Stallard
*Attorney, Agent, or Firm*—Gifford, Van Ophem, Sheridan & Sprinkle

[57] ABSTRACT

A short nozzle tip for a torch for thermochemical cutting or flame machining has a central cutting oxygen feed bore comprising an intake portion, a reduced-section portion and a conically flaring discharge portion. Associated with the central oxygen feed bore are fuel gas bores which extend parallel to the central bore and which are disposed in an annular array therearound, while arranged outside the array of fuel gas bores is a further array heating oxygen bores which extend at an inclined angle to the discharge end of the fuel gas bores and issue directly therebeside.

32 Claims, 8 Drawing Figures

109
105
104
108
103
110
101
106
112
114
113
102
115
L
111
107
116
α'
β'

121
120
104'
107'
106'
105'
112'
111'
103'
108'
110'
116'
114'
115'
102'
109'
101'
L

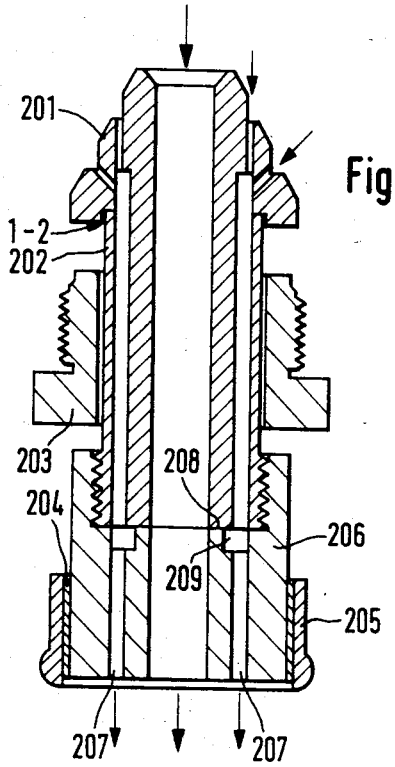
Fig. 4
Fig. 5
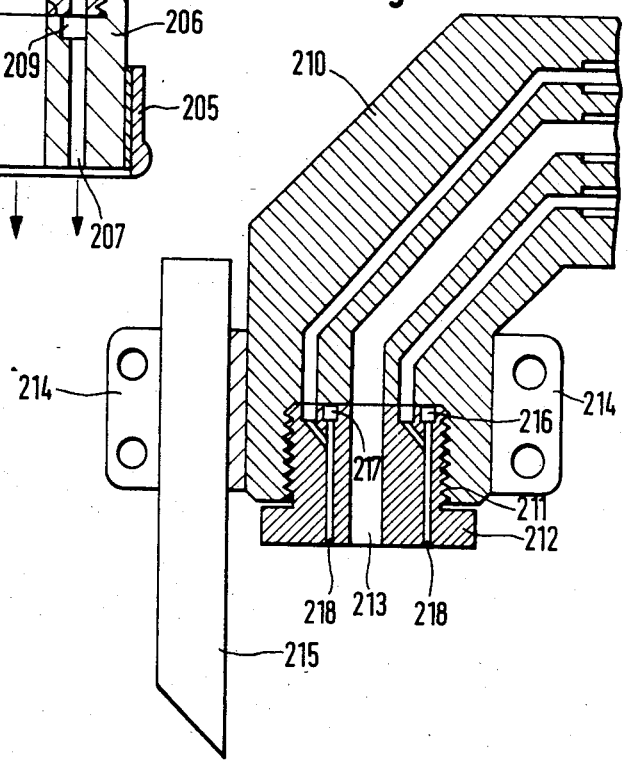

Fig. 7
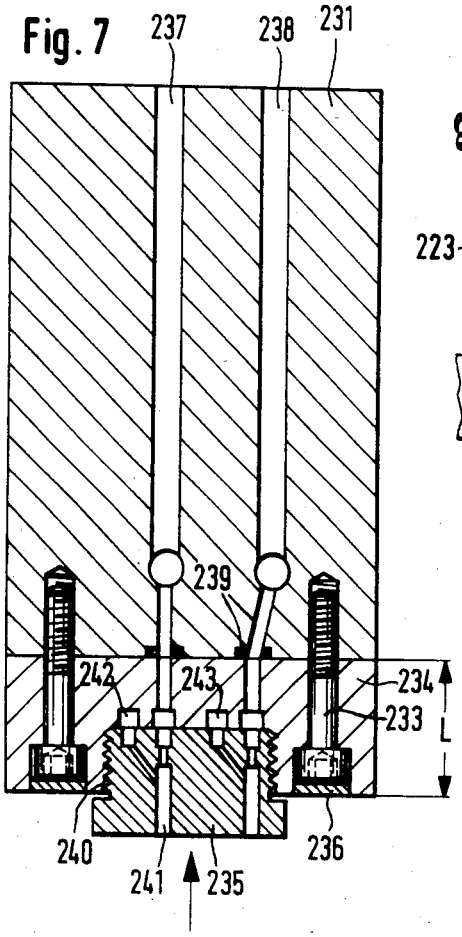
Fig. 6
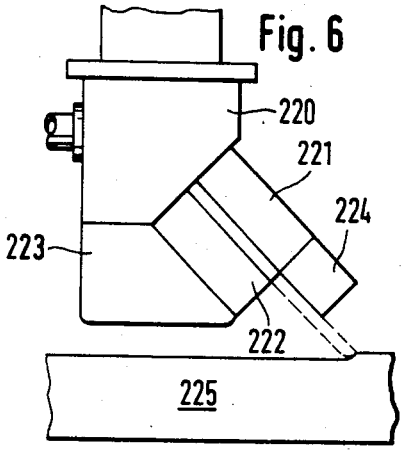
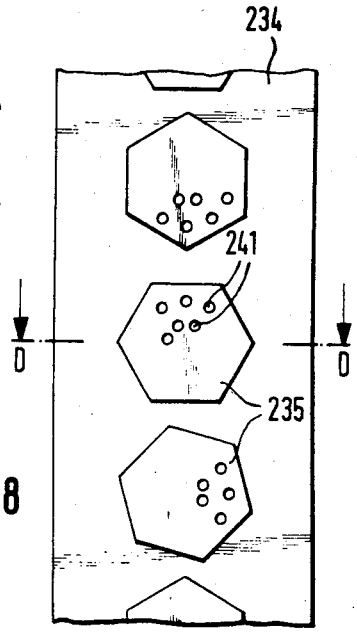
Fig. 8

SHORT TIP FOR A TORCH AND A TORCH TYPE TOOL

BACKGROUND OF THE INVENTION

The present invention relates to a round or flat short nozzle or tip for the thermochemical severing or planing off or flame machining of workpieces, and a torch type tool provided with a tip.

Torch nozzle tips of various kinds have a central oxygen cutting bore or passage for the feed of oxygen for cutting or flame machining purposes, with further bores for the feed of fuel or combustible gas and heating oxygen respectively, for preheating the steel or like material to be cut or machined, said further bores being disposed in an annular configuration around the oxygen cutting bore or passage, forming for example two rings of bores arranged symmetrically with respect to the axis of the tip, or alternatively rows of bores on respective sides of the centre plane of the tip.

Such nozzle tips are subject to a very wide range of requirements, but hitherto such tips have met such requirements, only to an unsatisfactory extent. For example, while a tip for cutting requires a high cutting speed, together with a small cut or kerf, the previous tips are usually optimised in one direction or the other, and are generally so designed as to comply with only certain operating requirements.

SUMMARY OF THE INVENTION

An object of the present invention is to provide a torch tip or nozzle, for cutting or flame-machining steel or the like, which provides a high cutting speed in conjunction with a narrow kerf, when cutting a workpiece.

Another object of the invention is a torch tip which gives a satisfactory configuration in respect of the heating system therein and the oxygen feed passage thereof.

Yet another object of the invention is to provide a torch tip of such a size and design as to save on the amount of material required to produce same and to reduce the rate of gas consumption thereof, as well as being easier to produce and having a good service life.

A further object of the invention is to provide a torch or burner type tool for flame machining of steel workpieces or the like, which is of substantially simplified construction, suitable for easily automated manufacture.

A still further object of the present invention is to provide a one-part or multi-part torch or nozzle tool which provides for facilitating repair and restoration of parts of the tool which may be affected by wear and/or damage.

According to the present invention, these and other objects are achieved by a short tip for a torch for thermochemical severing or planing off or flame-machining, which has a central oxygen bore or passage, with fuel gas and heating oxygen feed bores or passages disposed outside the central bore, as in an annular configuration around the central bore. The fuel or combustible gas bores extend parallel to the central oxygen bore, and the heating oxygen feed bores are disposed outside the combustible gas feed bores and extend at an inclined angle to the discharge end of the latter, issuing directly therebeside.

The heating oxygen feed bores also have an intake end portion which extends parallel to the axis of the tip, and which then goes into an inclined bore portion, which is preferably at an angle of about 4° to the axis of the tip.

In a preferred form of the tip, the tip has mixing bores in which combustible gas from the combustible gas feed bores and oxygen from the oxygen feed bores are mixed together, and the length of the tip is substantially determined by the length of the heating feed system which comprises annular distributor bores or transversely extending distributor passages, with short narrow metering bores, feeding into the mixing bores which are of sufficient length to produce their mixing action. A suitable oxygen jet is formed by means of a large feed cross-section portion in the supply of oxygen to the central oxygen bore or passage; the large cross-section portion is followed by a substantial constriction, which is abrupt or virtually without a transitional configuration, down to a metering cross-section which is for example from 1 to 4 mm in diameter, while being of small length, for example less than 10 mm. The metering cross-section portion in the oxygen feed bore is followed by a further portion which enlarges at a substantially uniform angle or in a multistepped configuration, to give a desired discharge cross-section or aperture of for example from 2 to 6 mm in size.

Further aspects and embodiments of a tip in accordance with the invention are set forth in further claims.

In another aspect of the invention, the invention provides a one-part or multi-part torch or nozzle type tool for oxygen flame machining of a workpiece of steel or the like, wherein portions of the tool which in use are towards the workpiece are in the form of one or more separate tool portions interchangeably connected to a main tool portion.

The tool may be in the form of a nozzle or tip of round configuration, having a central oxygen bore for flame machining and the like, and disposed therearound, bores for supplying a heating mixture for heating the material to be processed. The tool may comprise a main portion or carrier and a separate discharge or tip end portion which is screwed to the main portion.

Alternatively, the tool may be in the form of a nozzle or tip of flat configuration, comprising an upper plate, a lower plate and a protective skid or runner for protecting same. The upper plate projects beyond the end of the lower plate, at the discharge end of the tool, and is in the form of a separate discharge portion removably mounted to the main tool portion.

Further aspects and embodiments of the tool briefly defined above are also set forth in further claims.

Further objects, features and advantages of the present invention will be more clearly apparent from the following description of preferred embodiments thereof, with reference to the accompanying drawings.

BRIEF DESCRIPTION OF THE DRAWINGS

FIG. 4 shows a sectional view of a round nozzle or tip having a separately produced discharge portion which is screwed on to a main carrier portion, FIG. 5 shows a main carrier portion in the form of a nozzle or tip mounting arrangement, with a discharge portion screwed thereinto and a protective member mounted to the main carrier portion, FIG. 6 shows a diagrammatic view of a machine flame-machining nozzle or tip having an upper plate mounted to a carrier and gas distributor system and a lower plate, with a protective skid or runner member associated therewith, FIG. 7 shows a sectional view of the upper plate in FIG. 6 wherein an intermediate member is secured to the main tool portion, with the discharge portion being screwed into the intermediate member, in the form of a short nozzle tip, and FIG. 8 shows a plan view of an upper torch plate as shown in FIG. 4, illustrating some heating oxygen and heating gas bores.

DESCRIPTION OF PREFERRED EMBODIMENTS

Figure 1:
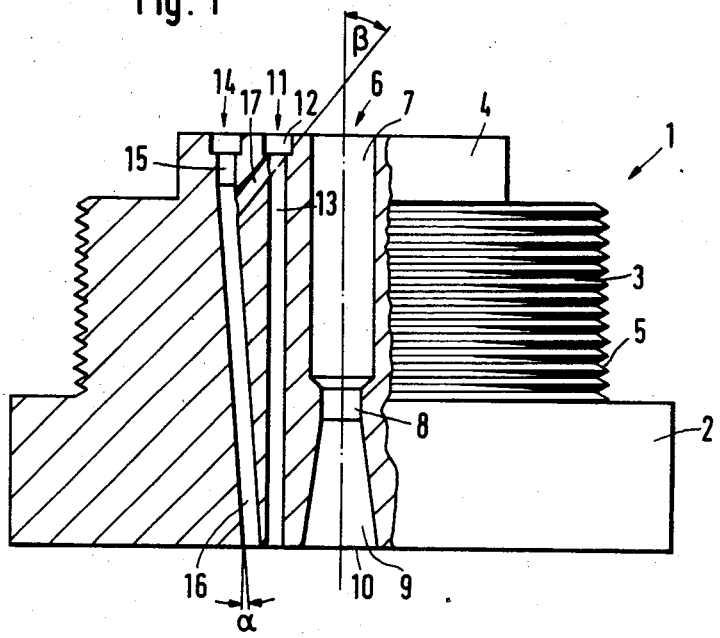
FIG. 1 shows a partly sectional view of a first, basic embodiment of a torch nozzle or tip.

Referring to FIG. 1, a flat nozzle or tip body 1 comprises a discharge portion 2, a central portion 3 which is of smaller diameter than the discharge portion 2, and an intake portion 4 which is also of smaller diameter than the central portion 3. The central portion 3 has a screwthread 5 for securing the nozzle or tip in position. As considered in the direction of the axis of the tip, the discharge portion 2 and the central portion 3 are of substantially the same dimension, while the intake portion 4 is of substantially shorter length. In an advantageous embodiment of the tip, the tip, as measured in the axial direction thereof, is of an overall length of 40 mm, with the discharge portion 2 and the central portion 3 each being 17 mm in length while the intake portion 4 is 6 mm in length. The tip has a central oxygen bore or passage 6 comprising an intake portion 7 which is followed, in the direction of discharge through the bore 6, by a central portion 8 which is of smaller diameter than the intake portion 7. The outlet portion 9 which follows the central portion 8 in the direction of discharge through the bore 6 is flared out in a conical configuration, from the central portion 8 to the discharge end 10. The central oxygen bore 6 is surrounded by combustible gas bores 11 which extend parallel and which each comprise an intake portion 12 which is followed by the actual bore 13, which is of smaller diameter than the intake portion 12. Heating oxygen bores 14 are arranged outside the bore 11. The oxygen bores or passages 14 comprise, at the intake end thereof, a portion 15 which extends parallel to the axis of the tip, and a bore portion 16 which adjoins the parallel portion 15 and which extends at an inclined angle. In that way, the oxygen bore 14 issues directly beside the combustible gas bore or passage 11. The inclined bore portion 16 of the bore 14 is preferably at an angle of 14° relative to the longitudinal axis of the nozzle. In order that fuel or combustible gas is already mixed with the heating oxygen in the bore or passage 14, the arrangement has a connecting bore or passage 17 which extends at an inclined angle from the intake bore portion 12 of the combustible gas bore 11, to the oxygen bore 14, where the connecting bore 17 opens into the inclined bore portion 16. The connecting bore or passage 17 forms an angle $\beta$ of about 50° relative to the axis of the nozzle or tip, but the magnitude of that angle depends on the geometrical parameters of the nozzle bores.

To adapt the nozzle or tip to different operating parameters, the central portion 8 of the oxygen supply bore 6 may tend towards nothing in the direction of the axis of the tip, so that the discharge portion 9 virtually directly adjoins the intake portion 7.

The present nozzle or tip not only makes it possible to achieve highly satisfactory working results, but in addition the nozzle or tip can also be produced at relatively low cost, and thus in a comparatively cost-effective manner, by means of a small number of working operations.

Figure 2:
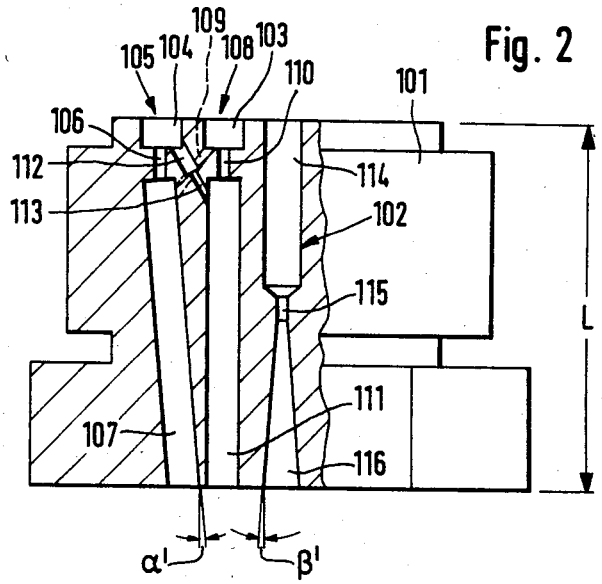
FIG. 2 shows a partly sectional view of a modified embodiment of the tip, for flame cutting.

Referring to FIG. 2, shown therein is a short nozzle or tip for flame cutting. The body 101, which is of an overall basic length L of 30 cm, is provided at the centre thereof with an oxygen cutting bore or passage 102 which is surrounded by parallel mixing combustible gas bores or passages 111. Disposed outside the passages 111 are mixing heating oxygen bores or passages 107 which extend at an inclined angle as indicated by $\alpha'$ to the discharge end of the passages 103, and which issue directly therebeside. The bores or passages 107 extend at an angle $\alpha'$ of from 4° to 5° relative to the axis of the tip. The bores or passages 107 have an annular distributor passage 104 into which opens a oxygen feed means 105 (not shown in greater detail herein). Heating oxygen metering bores or passages 106 extend from the distributor passage 104, and open into the actual heating oxygen mixing bores or passages 107. The bore 106 is of a diameter of about 1 mm, while the diameter of the heating oxygen mixing bore 107 is 2.3 mm. For the combustible gas, the tip has an annular combustible gas distributor passage 103 into which opens a combustible gas feed means 108 (not shown in greater detail herein). From the distributor passage 103, a combustible gas connecting bore or passage 109 extends at an inclined angle to the heating oxygen mixing bore or passage 107 and opens therein, at the upper end portion thereof. The connecting bore or passage 109 is also 1 mm in diameter.

Combustible gas feed means 108 (not shown in greater detail) open into the annular distributor passages 103. In that way, combustible gas can pass into the bores or passages 111 from the passages 103, through metering passages or bores 110. The bores or passages 110 are 1.3 mm in diameter. In contrast, the diameter of the bores 111, like the heating oxgyen mixing bore 107, is 2.3 mm. From the distributor passage 104, a heating oxygen connecting bore 112 goes to the bore or passage 111. In this arrangement, the bore or passage 112 has a metering portion 113 with a reduced cross-section, being about 0.5 mm. That arrangement therefore provides for an alternate, reciprocal feed of heating oxygen to the combustible gas mixing bore and of combustible gas to the heating oxygen mixing bore, whereby, besides the actual post-mixing effect which occurs after the gases issue from the heating oxygen mixing bore 107 and the combustible gas mixing bore 111, there is a pre-mixing operation, which is metered to a certain extent, insofar as small amounts of heating oxygen are fed into the combustible gas through the bore 112, while combustible gas is also fed to the heating oxygen, in the heating oxygen mixing bore 107, by way of the combustible gas connecting bore 109. From the structural point of view, that is achieved in that, by offsetting the distributed positions of the respective bores, the oxygen connecting bore 112, 113 and the combustible gas connecting bore 109 are disposed one behind the other, in the view shown in FIG. 2.

The oxygen cutting bore 102 comprises an intake portion 114, a reduced central portion 115 and a conically flaring discharge portion 116. The diameter of the intake portion 114 of the bore 102 is 5 mm while the adjoining constricted central portion 115 is 2.6 to 3.25 mm in diameter. The discharge portion 116 of the bore 102 has a discharge diameter of 4.3 mm, the discharge bore portion flaring outwardly at an angle $\beta'$ relative to the axial centre line of the nozzle or tip body, of 7°.

The above-described configuration of the tip for flame cutting provides a cut or kerf of optimum small width, while giving a very high cutting speed. The advantageous production of heat which also permits a high cutting speed to be attained provides for optimum removal of slag, resulting in only comparatively small flash portions of slag, as well as the entire cut surface being substantially better. The service life of the tips is substantially increased, because the tip spacing can be increased from the hitherto usual distance of 60 mm, to 120 mm. On the other hand, rapid tip exchange is possible, thereby providing for ease of maintenance. The nozzle or tip, being of an overall length L of 30 mm, requires a comparatively small amount of material and is also to be considered as inexpensive, from that point of view. The tip or nozzle is distinguished by producing a small amount of noise, and also by suffering from a low rate of wear. When operating with propane, at a pressure of 0.6 bar and at a heating oxygen pressure of 2.6 bar, it was possible to achieve very good results. As those multiple advantages are achieved with a nozzle or tip which, in spite of a high cutting speed, produces narrow kerfs so that there is a considerable saving of material, the invention provides a nozzle which can provide for simultaneous optimisation of the widely varying requirements which are made at the present time, in flame cutting. The operating pressures are 10 to 16 bars for the cutting oxygen, about 2.5 bar for heating oxygen and 0.6 bar for propane as the combustible gas.

Figure 3:
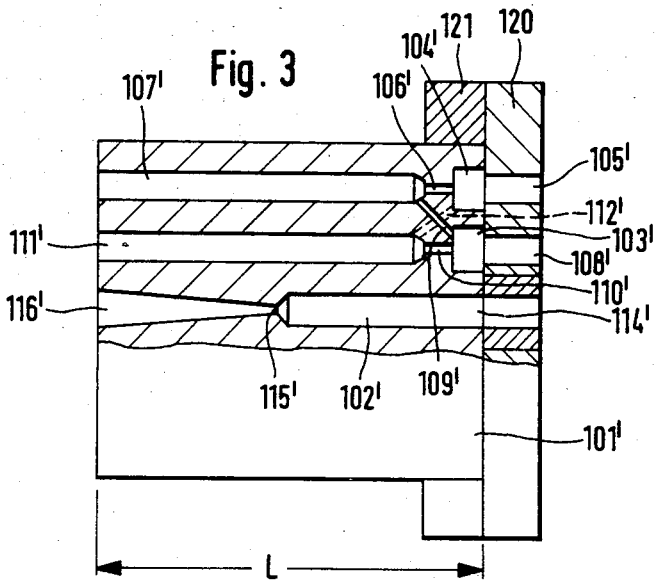
FIG. 3 shows a view which is also partly in cross-section, corresponding to the view shown in FIG. 2, illustrating an embodiment of the tip for flaming or flame machining.

FIG. 3 shows a short nozzle or tip for flame machining, which corresponds in its basic construction to the nozzle shown in FIG. 2, as can be seen from the use of the corresponding reference numerals. Mounted on the main body portion 101' of the nozzle or tip, on the end thereof which is remote from the discharge end, is a closure plate 120 which is secured by hard soldering or brazing or like manner. A ring member 121 may also be secured to the main body portion 101', to provide additional support, and the plate 120 can come to bear against the ring member 121. Formed centrally in the tip is a slot-like oxygen passage 102' which extends normal to the plane of the drawing and which has an intake portion 114' which goes into a reduced central portion 115' and which is followed by a conically flared discharge portion 116'. The discharge portion may also be of such a configuration as to be enlarged in steps. The intake portion 114' is not covered by the plate 120 so that the intake portion 114 is accessible for a flame machining oxygen feed (not shown). The intake plate 120 has a plurality of combustible gas feed means 108' through which the gas can pass into the transversely extending combustible gas distributor passages 103'. From the passages 103', combustible gas metering bores 110' pass into the combustible gas mixing bores 111', while in a corresponding manner, heating oxygen passes through the heating oxygen bores 109' in the plate 120, into the transversely extending heating oxygen distributor passages 104' and through heating oxygen metering bores 106' into the heating oxygen mixing bores 107'. Combustible gas is passed, with suitable metering, into the heating oxygen mixing bore 107' through a combustible gas connecting bore 109' which goes from the combustible gas distributor passage 103' into the heating oxygen mixing bore 107', while the heating oxygen connecting bore 112' feeds heating oxygen from the distributor passage 104' to the combustible gas mixing bore 111'. That therefore provides the same basic construction and also ensures a corresponding mode of operation, for a nozzle tip for flame machining. The length L of the main body portion 101' is also about 30 mm.

When using a short nozzle tip for flame machining, advantageous results were achieved with a flame machining oxygen passage 102', in which the intake portion 114' comprised a passage of from 3 to 6 mm in height, wherein the reduced-width central portion 115' had a gap of from 2 to 4 mm in height, while the discharge gap of the discharge portion 116' was from 3 to 5 mm. A nozzle tip of such a configuration made it possible to achieve substantially improved results in flame machining, in which connection, as already mentioned above, emphasis should be laid in particular on the short heating-up time and the improved surface quality of the workpiece.

FIG. 4 shows a sectional view of a round nozzle or tip, comprising a main tip portion as indicated at 201 and 202, which comprises one piece in which the component referred to as the tip head portion and the tip end portion are soldered or brazed together at the join 1-2. Carried on the main portion 201 and 202 is a compression screw member 203 which was pushed over the main portion 201 and 202 before a discharge portion 206 is mounted on the main portion 201 and 202, the portion 206 carrying a sleeve portion 204 which is brazed or soldered thereon, with a wear ring 205. For that purpose, the main portion 201 and 202 has a screwthread so that the discharge portion 206 can be screwed on to the tip. The heating gas-oxygen mixture is passed from the mixing bores in the main portion 201, 202 into the discharge bores 207 of the discharge portion 206 by way of an annular passage 209 which is arranged at the sealing surface 208 in the discharge portion 206. The annular passage 209 may alternatively be provided in the main portion 201, 202, at the sealing surface.

It is also possible for the main portion 201, 202 additionally to be split at the join 1-2 and thus comprise a main portion 201 forming the nozzle or tip head, and an intermediate portion 202 which is secured thereto and on to which the discharge portion 206 is screwed.

FIG. 5 shows an advantageous embodiment in which the above-described screw connection location is displaced into the region of the previous welded or brazed join. The main portion 210 of the tool is in the form of a nozzle or tip mounting arrangement on the torch assembly or machine torch means (not shown). The main tool portion 210 has a screwthread 211 into which a discharge portion 212 is screwed. The discharge portion 212 is in the form of a short nozzle or tip, in a similar manner as is known in connection with heavy cutting, with only one, larger central oxygen passage 213. This nozzle tip is easy and inexpensive to replace.

A protective member 215 is replaceably secured to the main tool portion 210, which is in the form of a nozzle tip mounting means, by means of a clip or clamp 214. The protective member 215 is provided in particular to prevent slag which may be sprayed or splattered up, from reaching the discharge portion 212 with its small nozzle openings. Because the protective member 215 is arranged displaceably and rotatably, it can be moved into the respective optimum position for satisfactorily performing its protective function. Because the protective member 215 is mounted on the main tool portion 210 or the nozzle mounting means, it is not connected to the discharge portion 212.

In this embodiment also, the heating oxygen and the heating gas are passed into the discharge portion 212 through annular passages 216 and 217, with the flows of gas mixing in the discharge bores 218.

FIG. 6 shows a machine torch or burner arrangement, wherein secured to a distributor means 220 is an upper torch or burner plate 221, a lower torch or burner plate 222 and a protective skid or runner 223. The flame-machining oxygen flow issues between the upper plate 221 and the lower plate 222, as shown in dotted lines in FIG. 6, while heating gas and heating oxygen issue through small bores at the end faces of the plates 221 and 222. The part of the upper plate 221 which projects beyond the lower plate 222 towards the workpiece 225 is in the form of a separate discharge portion 224 and is mounted removably on the main tool portion 21.

Reference will now be made to FIG. 7 showing a view of an embodiment of the nozzle or tip, in cross-section taken along line D—D in the plan view on to the front of the nozzle or tip as shown in FIG. 8, in which the upper plate is divided into three parts. On the main tool portion 231, the part which projects beyond the lower plate 222 by a distance L is in the form of an intermediate portion 234 into which the discharge portion 235 is screwed. The intermediate portion 234 is secured to the main portion 231 by means of screws 233, the screws 233 being protected by cover plate members 236, for example to protect them from splashed slag. Heating gas passages 237 and heating oxygen passages 238 are sealed by O-rings 239 at the division between the main portion 231 and the intermediate portion 234. In addition, cooling water bores (not shown) advantageously extend from the main portion 231 into the intermediate portion 234, through the latter, and back to the main portion 231.

Discharge portions 235 are carried in the intermediate portion 234 and are screwed thereinto, by means of a screwthread. Discharge bores 241 are combined together in groups, by the discharge portion 235, to constitute special heating nozzles or tips, as can be seen in particular from the plan view of FIG. 8. FIG. 8 shows the manner in which a plurality of discharge members 235 in the form of nozzles or tips, with their nozzle apertures 241 combined together in groups, are screwed to the end face of the intermediate portion 234. The nozzles are formed in the manner of known short nozzles or tips for heavy cutting, but without the oxygen cutting bore. Disposed in the separating surface between the intermediate portion 234 and the discharge portion 235 are annular passages 242 and 243 for heating gas and oxygen, with interposed sealing surfaces, to permit the flows to be distributed to the discharge bores 241 in the discharge portion 235, in known manner.

The above-described torch and nozzle arrangement involves a substantial simplification in production of the components. The arrangement avoids the need to operate with long boring members which break easily, or the arrangement avoids the necessity for additional bores from the rear and from the outside, which additional bores then have to be sealed off again with additional sealing plate members. If, in operation, splashes or sprays of slag cause fouling of the heating mixture bores and contaminate and cover the surface guiding flame-machining oxygen, there is no longer any need for a complicated operation of cleaning slag from the bores and the surfaces using wire brushes, files and hand drills, as the separate discharge portion is easily replaced. In addition, it is no longer necessary in this way to tolerate changes in shape and cross-section on the tool. Likewise, damage is substantially less and easier to deal with, if damage is caused by knocking or putting down the torch. The invention therefore provides a nozzle tool which, besides cheaper production, also permits cheaper operation or maintenance and repair.

What is claimed is:

1. A short tip for a torch, comprising a central oxygen passage; disposed adjacent the central oxygen passage, combustible gas feed passage means extending substantially parallel to said passage; and, disposed outside the combustible gas feed passage means, heating oxygen feed passage means which have at least a substantial portion extending at an inclined angle to the discharge end of the combustible gas feed passage means and issuing directly therebeside.

2. A tip as set forth in claim 1 wherein said at least substantial portion of the heating oxygen feed passage means extends at an angle of substantially 4° to the axis of the tip.

3. A tip as set forth in claim 1 wherein said heating oxygen feed passage means comprise an intake portion that extends parallel to the axis of the tip and then goes into an inclined portion.

4. A tip as set forth in claim 1 including a connecting passage extending at an inclined angle to the heating oxygen feed passage means from the intake portion of the combustible gas passage means.

5. A tip as set forth in claim 4 wherein said connecting passage extends at an angle of substantially 40° to 60° to the axis of the tip.

6. A tip as set forth in claim 4 wherein said connecting passage opens into the said inclined portion of the heating oxygen feed passage means.

7. A tip as set forth in claim 1 wherein said central oxygen passage comprises an intake portion, a reduced-section portion and a conically flared discharge portion.

8. A tip as set forth in claim 7 wherein said reduced-section portion is of a dimension that tends towards zero, in the direction of the axis of the tip.

9. A tip as set forth in claim 1 wherein said gas and oxygen feed passage means include respective mixing portions adapted to provide for mixing of gas and oxygen introduced thereinto from the respective other feed passage means, and wherein the length of the tip is substantially determined by the length of a heating feed system comprising combustible gas and oxygen distributor passages, short narrow metering passages communicating therewith, and said mixing portions which communicate with said metering passages and which are of just sufficient length for their mixing action, and by the formation of a suitable oxygen jet by virtue of said central oxygen passage having a large feed cross-section followed by a substantial abrupt constriction to a metering cross-section of from substantially 1 to 4 mm in transverse dimension, being of small length of less than 10 mm, and in turn followed by an enlarging portion which increases to a desired discharge cross-section of 2 to 6 mm.

10. A tip as set forth in claim 9 wherein said distributor passages are of an annular configuration.

11. A tip as set forth in claim 9 wherein said distributor passages extend transversely of the tip.

12. A tip as set forth in claim 9 wherein said enlarging portion is of a uniformly enlarging form.

13. A tip as set forth in claim 9 wherein said enlarging portion enlarges in a multi-step configuration.

14. A tip as set forth in claim 9 wherein at least one array of said mixing passages extends at an inclined angle to the discharge end, relative to the central oxygen passage.

15. A tip as set forth in claim 14 wherein said array is an annular array around said central passage.

16. A tip as set forth in claim 14 wherein said array is at least one row on each side of said central passage.

17. A tip as set forth in claim 14 comprising first and second annular arrays of said mixing passages, the outer annular array being inclined and the inner annular array being parallel, relative to the central oxygen passage.

18. A tip as set forth in claim 14 comprising first and second rows of said mixing passages on respective sides of said central oxygen passage, the outer rows being inclined and the inner rows being parallel, relative to said central passage.

19. A tip as set forth in claim 9 including connecting passages having a metering flow section whereby each said component of the mixture produced in said mixing passages is fed to the respective other component of said mixture for mixing in the respective mixing passages, said connecting passages communicating with said mixing passages close to the respective said metering passage which is aligned with and communicates with the respective mixing passage, wherein an outer said distributor passage supplies heating oxygen and the respective inner distributor passage supplies combustible gas, and wherein the connecting passages leading to the inner mixing passage are matched therewith in such a way that in operation there is an excess of combustible gas relative to the heating oxygen.

20. A tip as set forth in claim 9 wherein said outer mixing passages extend at an angle of substantially 4° to 5° relative to the axis of the tip.

21. A tip as set forth in claim 9 wherein said heating oxygen metering passage is substantially 1 mm in diameter.

22. A tip as set forth in claim 9 wherein each said mixing passage is substantially 2.3 mm in diameter.

23. A tip as set forth in claim 9 wherein said combustible gas connecting passage extends from the combustible gas distributor passage at an inclined angle to the outer mixing passage and is substantially 1 mm in diameter.

24. A tip as set forth in claim 9 wherein said combustible gas metering passage extends from the combustible gas distributor passage to the communicating mixing passage and is substantially 1.3 mm in diameter.

25. A tip as set forth in claim 19 wherein said connecting passage which is arranged to feed heating oxygen from the heating oxygen distributor passage into the respective other mixing passage includes a bore portion with a metering diameter of substantially 0.5 mm.

26. A tip as set forth in claim 1 wherein said central oxygen passage comprises an intake portion, a constricted central portion, and a conically flaring discharge portion.

27. A tip as set forth in claim 26 wherein, for oxygen cutting, said intake portion is about 5 mm in diameter, the adjoining reduced portion is about 1.8 to 2.6 mm in diameter and the conically flaring discharge portion has a discharge aperture of about 4.3 mm.

28. A tip as set forth in claim 26, wherein for flame-machining said intake portion is about 3 to 6 mm in size, the reduced portion is about 2 to 4 mm in size, and the conically flaring discharge portion has a discharge aperture of about 3 to 5 mm in size.

29. A tip as set forth in claim 27 wherein said discharge portion is enlarged at an angle of about 7° to the axis of the tip.

30. A tip as set forth in claim 28 wherein said discharge portion is enlarged at an angle of about 7° to the axis of the tip.

31. A tip as set forth in claim 1 comprising a main body portion which is of a length of about 30 mm.

32. A tip as set forth in claim 1 and further including a plate member having feed passages therein, the plate member being secured to the intake end of the tip and the feed passages therein communicating with the respective passage means in the tip.

* * * * *